US009335742B2

(12) United States Patent
Jeong

(10) Patent No.: US 9,335,742 B2
(45) Date of Patent: May 10, 2016

(54) METHOD OF CONTROLLING ALARM FUNCTION AND ELECTRONIC DEVICE SUPPORTING THE SAME

(71) Applicant: Samsung Electronics Co., Ltd., Suwon-si, Gyeonggi-do (KR)

(72) Inventor: Seoghee Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/198,898

(22) Filed: Mar. 6, 2014

(65) Prior Publication Data

US 2014/0286137 A1 Sep. 25, 2014

(30) Foreign Application Priority Data

Mar. 25, 2013 (KR) ..... 10-2013-0031376

(51) Int. Cl.
*G04G 13/02* (2006.01)

(52) U.S. Cl.
CPC ..... *G04G 13/023* (2013.01); *G04G 13/02* (2013.01)

(58) Field of Classification Search
CPC ..... G04G 13/02; G04G 13/021–13/026; G04C 21/00; G04C 23/00
See application file for complete search history.

(56) References Cited

U.S. PATENT DOCUMENTS

| | | | | |
|---|---|---|---|---|
| 5,442,600 | A * | 8/1995 | Kutosky | 368/109 |
| 7,978,565 | B2 * | 7/2011 | Coffaro et al. | 368/109 |
| 2001/0048639 | A1 * | 12/2001 | Davidson | 368/82 |
| 2003/0095476 | A1 * | 5/2003 | Mollicone et al. | 368/250 |
| 2005/0012622 | A1 * | 1/2005 | Sutton | 340/573.1 |
| 2005/0237862 | A1 * | 10/2005 | Choi | 368/250 |
| 2006/0293608 | A1 * | 12/2006 | Rothman et al. | 600/545 |
| 2007/0189124 | A1 * | 8/2007 | Cuisinier | 368/73 |
| 2009/0231964 | A1 * | 9/2009 | Kraft et al. | 368/250 |
| 2010/0296370 | A1 * | 11/2010 | Holmes et al. | 368/73 |
| 2011/0160619 | A1 * | 6/2011 | Gabara | 600/595 |
| 2011/0230790 | A1 * | 9/2011 | Kozlov | 600/595 |
| 2011/0295083 | A1 * | 12/2011 | Doelling et al. | 600/301 |
| 2012/0253220 | A1 * | 10/2012 | Rai et al. | 600/544 |
| 2013/0018284 | A1 * | 1/2013 | Kahn et al. | 600/595 |
| 2013/0208576 | A1 * | 8/2013 | Loree et al. | 368/256 |

* cited by examiner

*Primary Examiner* — Amy Cohen Johnson
*Assistant Examiner* — Matthew Powell
(74) *Attorney, Agent, or Firm* — Jefferson IP Law, LLP

(57) ABSTRACT

A method of controlling an alarm with a more improved alarm function and an electronic device supporting the same are provided. The method of controlling an alarm includes determining sleep start time information and alarm start time information, calculating a sleep time based on the sleep start time information and the alarm start time information, and outputting an alarm having a different characteristic according to a length of the calculated sleep time.

18 Claims, 5 Drawing Sheets

METHOD OF CONTROLLING ALARM FUNCTION AND ELECTRONIC DEVICE SUPPORTING THE SAME

CROSS-REFERENCE TO RELATED APPLICATION(S)

This application claims the benefit under 35 U.S.C. §119 (a) of a Korean patent application filed on Mar. 25, 2013 in the Korean Intellectual Property Office and assigned Serial number 10-2013-0031376, the entire disclosure of which is hereby incorporated by reference.

TECHNICAL FIELD

The present disclosure relates to an operation of an electronic device. More particularly, the present disclosure relates to an alarm operation of the electronic device.

BACKGROUND

In recent years, various user functions of an electronic device have been supported to be integrally operated based on development of a hardware technology. The electronic device according to the related art supports an alarm function to output alarm at a preset time.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above problems and/or disadvantages and to provide at least the advantages described below. Accordingly, an aspect of the present disclosure is to provide a method of controlling an alarm having a more improved alarm function and an electronic device supporting the same.

In accordance with an aspect of the present disclosure, a method of controlling an alarm in an electronic device is provided. The method includes determining sleep start time information and alarm start time information, calculating a sleep time based on the sleep start time information and the alarm start time information, and outputting an alarm having a different characteristic according to a length of the calculated sleep time.

In accordance with another aspect of the present disclosure, an electronic device is provided. The device includes a controller configured to determine sleep start time information and alarm start time information, to calculate a sleep time based on the sleep start time information and the alarm start time information, and to control output of an alarm having a different characteristic according to a length of the calculated sleep time, and an output unit configured to output the alarm.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
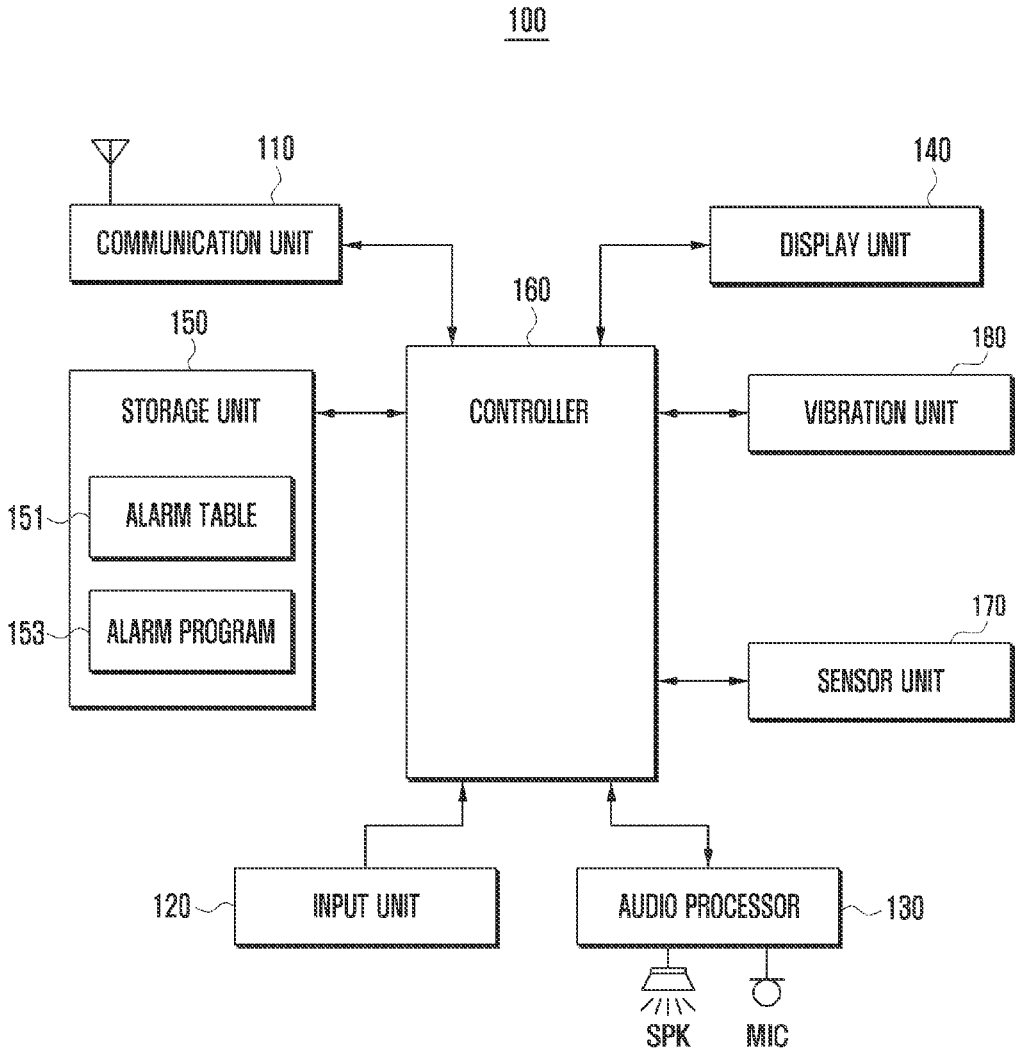
FIG. 1 is a block diagram illustrating a schematic configuration of an electronic device for supporting an alarm control function according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

An electronic device 100 according to the present disclosure may calculate a sleep time of a user and may automatically control a characteristic of an alarm according to a length of the calculated sleep time. Further, the electronic device 100 may output an alarm of a specific form according to the automatically controlled characteristic of the alarm. The electronic device 100, according to the present disclosure, may adaptively output the alarm by providing various types of alarms according to a length of the sleep time of the user. In particular, at least one of a size of the alarm and/or a number of snoozes may be controlled according to the length of the sleep time of the user. Accordingly, the electronic device may provide relatively light alarm to a user who relatively sleeps well, and may provide a relatively heavy alarm to a user who relatively sleeps badly.

A type of the sleep may be classified based on at least one of a quantitative part and/or a qualitative part of the sleep. For example, the present disclosure may control a characteristic of alarm in a quantitative part related with the sleep time. Further, the electronic device according to the present disclosure may control the characteristic of the alarm related with the qualitative part of the sleep.

For example, when the electronic device 100 includes a location detector, such as a GPS, current location information of the electronic device 100 may be determined. Further, the electronic device 100 may apply weight to the qualitative part of the sleep of the user according to the location information. That is, when a location of the device is detected to be a house, a type of the sleep may be considered to be better than a case in which the device is located outside.

Further, the electronic device 100 may classify the qualitative part of the sleep with levels according to time zones. For example, the electronic device 100 may allocate a relatively excellent qualitative level to a sleep time ranging from 12 o'clock at night to 4:00 a.m. as compared with other time zones. That is, the electronic device may apply different weights according to time zones of the sleep. As a result, the electronic device may apply different levels to the same sleep time based on state information related with sleep, such as a time and a location. A level applied to the sleep time will be described later but may become a reference to vary a characteristic of the alarm.

The characteristic of the alarm may be classified by meaningful terms, such as light or heavy. A lightness and a heaviness of the alarm may be classified according to an output type of the alarm. For example, when the alarm is provided through a voice, a state having a relatively low volume may be defined as a light alarm, and a state having a relatively high volume may be defined as a heavy alarm. Further, when a voice provided through the alarm has a relatively high frequency band, it may be defined as the heavy alarm. When the voice provided through the alarm has a relatively low frequency band, it may be defined as the light alarm.

Further, when an executed time of the alarm is set to be relatively long, the alarm may be defined as the heavy alarm. When the executed time of the alarm is set to be relatively short, the alarm may be defined as the light alarm. Further, when the number of snoozes is relatively large and a repeat performance interval of the snooze is short, the alarm may be defined as the heavy alarm. When the number of snoozes is relatively small and a repeat performance interval of the snooze is long, the alarm may be defined as the light alarm. The light alarm and the heavy alarm may be one reference in terms of defining the characteristic of the alarm. When such reference is applied to the electronic device 100, a meaningful term, such as light or heavy, may be expressed as a specific level, specific values, or an arbitrary value of a certain characteristic. In terms of a designer who designs the characteristic of the alarm or a user who understands and uses the characteristic of the alarm, expressions of the alarm, such as light and heavy, may be intuitively and easily used.

Accordingly, in terms of a design, in order to define a meaningful state, corresponding to light and heavy, of the alarm, various elements, such as a volume and/or a bit of the alarm, a frequency band, a vibration pattern, and/or the number of snoozes or an execution interval of the snoozes may be experimentally and statistically calculated and provided. The lightness and/or the heaviness of the alarm may be classified by a simplified type, such as a song genre, for example, a ballad or a dance genre, to be used for an alarm sound and/or a vibration pattern. In this case, the ballad genre may be provided as a relatively light alarm and the dance genre may be provided as a relatively heavy alarm. As described above, the characteristic of the alarm of the present disclosure may be variously changed and used according to an intention of a designer, a trend when the present disclosure is applied, and/or a preference of the user. Accordingly, a technical concept of the present disclosure is not limited to lightness and/or heaviness of the alarm, but can be understood as variation of any similar and/or suitable characteristics of the alarm based on a sleep time of the user.

As described above, the electronic device 100 of the present disclosure may differently provide an alarm characteristic according to sleep information of the user.

FIG. 1 is a block diagram illustrating a schematic configuration of an electronic device for supporting an alarm control function according to an embodiment of the present disclosure.

Referring to FIG. 1, the electronic device 100, according to the present disclosure, may include a communication unit 110, an input unit 120, an audio processor 130, a display unit 140, a storage unit 150, and a controller 160. The electronic device 100 according to the present disclosure may further include a vibration unit 180 to output an alarm and a sensor unit 170 to collect state information of the electronic device 100. In addition, the electronic device 100 may further include a lamp unit (not shown) to output the alarm as at least one of an output unit (not shown) and/or an element included in the output unit. The output unit to output the alarm in the electronic device of the present disclosure may include at least one of the audio processor 130, the display unit 140, the lamp unit, and the vibration unit 180. When the lamp unit is separately added, a corresponding configuration may be included.

The communication unit 110 supports a communication function of the electronic device 100. The communication unit 110 forms at least one communication channel to support an application needed for communication, such as a message service function, a web page search function, an image call function, a voice call function, a data transmission and/or reception function, and a cloud function. The communication unit 110 may include a mobile communication module in a case where the electronic device supports a mobile communication function. Further, in a case where the electronic device 100 supports a broadcasting reception function, the communication unit 110 may include a broadcasting reception module. The communication unit 110 forms a specific communication channel and transmits and/or receives data through a corresponding communication channel, the transmitted and/or received data may be provided to the controller 160.

When a communication function by the communication unit 110 is provided during a procedure of calculating a sleep time, the electronic device 100 may change calculation of the sleep time. In more detail, a method of calculating the sleep time by the electronic device 100, according to the present disclosure, may determine an operation of the electronic device from a corresponding time point based on a bedtime previously set by the user or a bedtime set as default by a system. If an event due to the operation of the electronic device 100 does not occur for an amount of time, i.e., a time period and/or a predetermined amount of time, after a corresponding time point, the electronic device 100 may determine that the user enters sleep and may calculate a sleep time.

During such procedure, the communication unit 110 may receive a communication call connection request and/or a message and/or an e-mail regardless of the sleep of the user. In this case, the electronic device 100 may control a sleep time or perform control to disregard application of a call function according to a user processing type of the received call function. For example, when the communication unit 110 rejects the received communication call connection request, the electronic device 100 may disregard reception of a communication call during a procedure of calculating the sleep time. When reception of the communication call is accepted such that the electronic device 100 forms a communication channel, the electronic device 100 may control the sleep time by considering a formation period of the communication channel. For example, the electronic device 100 may reduce the sleep time proportional to the formation time of the communication channel of the communication unit 110. Alternatively, when a formation time of the communication channel of the communication unit 110 is elapsed, the electronic device 100 may initialize the sleep time. Further, when an event associated with an operation of the electronic device 100 does not occur after termination of the communication channel and/or for an amount of time, the electronic device 100 may restart the calculation of the sleep time.

The electronic device 100 may control so as not to apply a status in which the message is received and a status in which a determination for message reception is performed according to the calculation of the sleep time, when receiving the message by the communication unit 110. Further, if a response message to the message is transmitted, the electronic device 100 resets calculation of the sleep time. If an operation event of the electronic device 100 does not occur for an amount of time after transmission of the response message, the electronic device 100 may restart calculation of the sleep time.

The input unit 120 generates various input signals needed for an operation of the electronic device 100. The input unit 120 may be configured in a form of a key, such as a button key, a side key, a home key, and/or any other similar and/or suitable key. The input unit 120 may generate an input signal to set the alarm, an input signal to stop execution of the alarm, an input signal to cancel an alarm according to user control, and/or any other similar and/or suitable input signal corresponding to the alarm.

When the display unit 140 is provided in a form of a touch screen supporting a touch function, the input unit 120 may include the display unit 140. A touch event generated from the display unit 140 is transferred to the controller 160, and the controller 160 may apply the touch event to an executed application. The alarm may be set and/or the set alarm may be changed according to a touch event generated from the display unit 140. An executed alarm may be stopped according to the touch event generated from the display unit 140 having a touch function.

The audio processor 130 processes various audio signals generated during an operation procedure of the electronic device 100. For example, the audio processor 130 may include a speaker SPK to output an audio signal generated and/or decoded from the electronic device 100. Further, the audio processor 130 may include a microphone MIC to collect the audio signal in order to support a voice call and/or image call function and a recording function. In particular, when a preset alarm time comes, the audio processor 130 may output an audio signal according to an alarm characteristic through the speaker SPK. In particular, the audio processor 130 may output an audio signal having different characteristics depending on a sleep degree. For example, when the sleep degree is less than or equal to a first level, the audio processor 130 may output an audio signal which is previously set as at least one of an audio signal having a relatively high frequency band and/or an audio signal having a relatively high volume level. When the sleep information is equal to or greater than a second level different from the first level, the audio processor 130 may output an audio signal which is previously set as at least one of an audio signal having a relatively low frequency and/or an audio signal having a relatively low volume level. The audio processor 130 may collect neighboring audio signals by activating the microphone MIC when outputting the alarm. Further, the audio processor 130 may differently control amplitude of the alarm according to a level and/or a size of a neighboring audio signal, for example, a volume level and/or a decibel size of a sound. For example, if it is determined that a surrounding of the electronic device 100 is noisy according to the neighboring audio signal, the audio processor 130 outputs the audio signal having a volume larger than a preset volume under control of the controller 160. If it is determined that the surrounding of the electronic device 100 is silent according to the neighboring audio signal, the audio processor 130 may output an audio signal having a preset volume and/or a volume smaller than a preset volume under control of the controller 160. In this case, the output audio signal may be an audio signal determined according to sleep information of a user.

The display unit 140 outputs various function screens needed for an operation procedure of the electronic device according to the present disclosure. For example, the display unit 140 may output a menu screen, a specific application operation screen, a plurality of application operation screens, and a whole screen of a specific application during an operation of a plurality of applications. The display unit 140 may output an alarm setting screen, an alarm execution screen, and a specific screen according to a stop of alarm execution. Further, the display unit 140 may output an idle screen including alarm information in a state in which the alarm is set. The alarm setting screen may be a screen capable of setting a characteristic of the alarm for each sleep information. The alarm execution screen may include text information and image information to be output to the display unit 140 while the alarm is executed if a preset alarm time comes. An alarm execution stop screen may become an idle screen and/or a screen having previously defined schedule information. The above screens will be described with reference to following drawings.

Meanwhile, the above display unit 140 may include a touch detector and a display panel to support an input function. Further, the display unit 140 may include a pen touch detector to operate an electronic pen. The touch detector may be a capacitive type or resistive type panel to detect physical and/or electric variation due to a user's finger touch. The touch detector is disposed in at least one of a front surface and/or a rear surface of the display panel and provides location information corresponding to a touch by a finger and/or a touch tool and/or contact and/or proximity gesture information according to movement of the finger and/or the touch tool to the controller 160. The touch event information generated by the touch detector is provided to the controller 160, and the touch event information may be used to set the alarm and/or stop an executed alarm.

The display panel is a region which outputs screen configuration elements. The display panel is mapped to the touch detector and outputs various screen configuration elements. For example, the display panel may output a specific application operation screen from among a plurality of application operation screens. The display panel may include various display panels, such as a liquid crystal display panel which implements a screen by using light provided from a backlight and an Organic Light Emitting Diode (OLED), which implements a screen by using a self-emitted light. The above display panel may perform an operation of switching on and off of a certain pattern by using a preset method when executing the alarm.

The storage unit 150 may store various application programs needed and/or used for an operation of the electronic device 100 and various application data generated by operating the electronic device 100. For example, the storage unit 150 may store programs, such as an operating system used to operate the electronic device 100. The storage unit 150 may include an alarm program 153 and an alarm table 151 to support execution and release of the alarm.

The alarm table 151 may include preset alarm values. For example, as listed in a following Table 1, alarm characteristic values defined for each of a plurality of sleep times may be included.

TABLE 1

| Sleep time | Alarm type | Alarm tone | Volume | Snooze |
|---|---|---|---|---|
| 0~4 | Melody | Noisy music | 10(Max) | 10 |
| 4~6 | Melody | Noisy music | 8 | 3 |
| 6~8 | Melody | Rhythmical music | 5 | 1 |
| 8~12 | Vibration | Soft music | 2 | X |
| 12~24 | Mute | X | X | X |

Table 1 illustrates values defining alarm characteristics for each of the plurality of sleep times corresponding to quantitative values. When asleep time is less than or equal to eight hours, the electronic device 100 may provide a melody. When the sleep time is greater than eight hours, the electronic device 100 may provide a vibration and/or no sound. Further, when providing the melody, if the sleep time is six hours or less, the electronic device 100 outputs a noisy music. If the sleep time is greater than six hours, the electronic device 100 outputs a rhythmical, soft, or silent music. The noisy music, the rhythmical music, and the soft music may be classified according to a frequency characteristic and/or a bit characteristic of a corresponding music, and a number and/or types of musical instruments. For example, the noisy music may include much low-pitched sounds and high-pitched sounds with a relatively rapid bit characteristic compared to a soft music, and may have much variation in the low-pitched sound and the high-pitched sound. Accordingly, although the Table 1 has listed meaningful terms such as noisy or soft music, in the above configuration elements, the music of a specific genre may be substituted by a music having a specific bit characteristic according to preference of a user or a design method of a designer.

Meanwhile, Table 1 illustrates that only a quantitative part for the sleep time is applied to determination of alarm characteristics, but the electronic device 100 may support application of a qualitative part to the sleep time. For example, as described above, the electronic device may differently apply weights according to a current location of the device and a sleep time slot. For example, although the sleep time is determined to be nine hours, if 0.5 is applied as a weight according to application of the location and the sleep time slot, the electronic device 100 may determine that the sleep time is four hours and thirty minutes with respect to the sleep time of 9 hours. When 0.8 is applied as weight according to classification of the location and the sleep time slot, the electronic device 100 may determine that the sleep time is seven hours and twelve minutes corresponding to 0.8 times of nine hours. In this case, based on Table 1, the sleep time of the user may be determined as the sleep time of 6 to 8 hours which is a third level that is a corresponding level. Accordingly, the electronic device 100 may output an alarm depending on an alarm characteristic which is set according to the corresponding level.

The alarm program 153 may include a routine to set the alarm and a routine to execute the alarm. The routine to set the alarm may include a screen providing routine capable of changing alarm characteristic values for each of the plurality of sleep times described in Table 1 and a routine of supporting the change of values according to an input signal. In addition, the routine to set the alarm may include a routine of supporting the change of weight values for elements such as a location and a time of the electronic device 100. The routine to execute the alarm may include a timer providing routine to determine a time point of a bedtime start, a timer providing routine to detect the sleep time, a timer providing routine to detect an alarm start time, each timer driving control routine, and a routine to perform a function defined according to termination of a corresponding timer when each timer is terminated. When the alarm is set, the alarm program 153, as described above, is loaded into the controller 160 and may support the change of alarm characteristics based on sleep information of the present disclosure.

The vibration unit 180 may vibrate with a specific pattern according to defined information when the alarm is executed. The vibration unit 180 may vibrate with various patterns for each of the plurality of sleep times. Further, the vibration unit 180 may generate the vibration having various sizes for each of the plurality of sleep times. When only application of a vibration pattern is set during a procedure of setting the alarm, only output of the vibration of the vibration unit 180 may be performed without output of the audio signal. Conversely, when only output of the audio signal is set during a procedure of setting the alarm, the vibration unit 180 may maintain a non-operation state when an alarm time comes. When both of the output of the audio signal and the performing of the vibration are set, the vibration unit 180 may be operated together with output of the audio signal from the audio processor 130.

The sensor unit 170 collects sensor signals according to a state of the electronic device 100. For example, the sensor unit 170 may include at least one of an acceleration sensor, a geomagnetic sensor, a gyro sensor, and/or any other similar and/or suitable sensor. Accordingly, the sensor unit 170 may collect at least one sensor signal according to movement of the electronic device 100. The sensor signal collected by the sensor unit 170 is provided to the controller 160 so that the collected sensor signal may be used to determine a bedtime.

The controller 160 processes various signals and data related with an operation of the electronic device 100 according to the present disclosure. For example, the controller 160 may set and execute the alarm. To this end, the controller 160 may include constituent elements as illustrated in FIG. 2.

Figure 2:
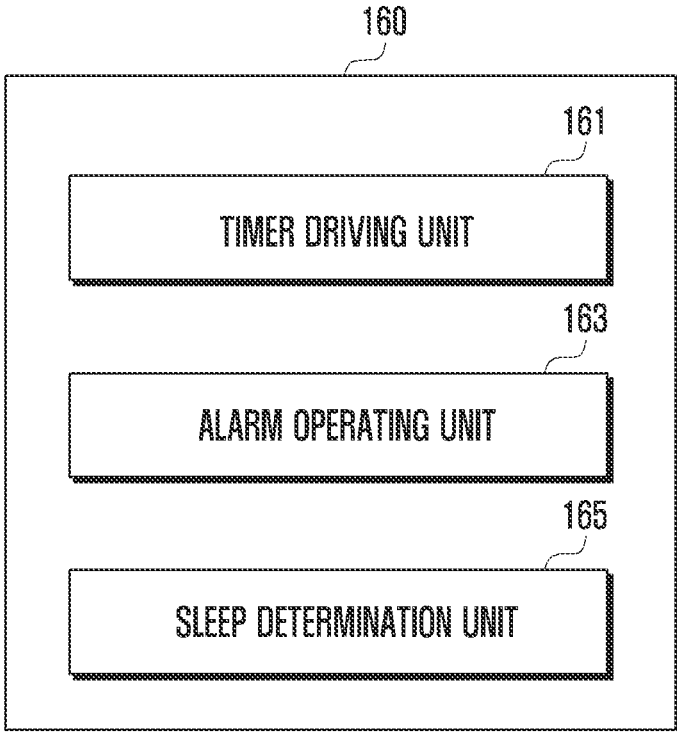
FIG. 2 is a block diagram illustrating a configuration of a controller shown in FIG. 1 according to an embodiment of the present disclosure.

FIG. 2 is a block diagram illustrating a configuration of a controller according to an embodiment of the present disclosure.

Referring to FIG. 2, the controller 160 may include a timer driving unit 161, an alarm operating unit 163, and a sleep determination unit 165.

The timer driving unit 161 includes at least one timer, and may control drive of each of the at least one timer. The timer driving unit 161 drives a timer to detect coming of a previously defined bedtime. When the timer is terminated, the timer driving unit 161 may drive a timer to determine a sleep condition. In addition, the timer driving unit 161 may provide timer driving information to the sleep determination unit 165. In this case, the timer driving unit 161 may reset a timer according to determination of the sleep determination unit 165. Furthermore, the timer driving unit 161 may drive a timer to detect coming of a preset alarm time. In addition, when the alarm time comes, the timer driving unit 161 may provide alarm execution request information to the alarm operating unit 163.

The sleep determination unit 165 may determine the sleep by considering the generation of at least one of information related to termination of the timer provided from the timer driving unit 161, information provided from at least one of the communication unit 110, the input unit 120, and/or the sensor unit 170, and information according to an operation of the electronic device 100 including application execution information. For example, if information related to the operation, such as moving the electronic device 100 and/or driving an application, of the electronic device 100 is generated before terminating the timer, the sleep determination unit 165 may request the timer driving unit 161 to reset the timer. At this time, if the information related to the operation of the electronic device 100 is not generated until the timer is terminated, the sleep determination unit 165 may determine that the sleep is started. In this case, the sleep determination unit 165 may provide a sleep start time to the alarm operating unit 163. The information on the operation of the electronic device 100 may be information on an extent which may be admitted as the sleep hindrance. Various elements or only a specific element may be applied as the extent that may be admitted as sleep hindrance according to a design method. The electronic device 100 may provide at least one of a call connection item, a message item, and an application operation item corresponding to sleep hindrance as a menu, which the user may select. Accordingly, the user may select one from among the above items, and may set time information of the above items.

When information related to the operation of the electronic device 100 is generated during the sleep, the sleep determination unit 165 may determine whether to release the sleep by determining at least one of a type and a characteristic of corresponding generated information. Further, when information related to sleep release is generated, the sleep determination unit 165 may transmit a request reset of a sleep timer to the timer driving unit 161. Further, the sleep determination unit 165 may provide information on a generation time of sleep release information to the alarm operating unit 163. Here, the information related to sleep release may be information indicating a state in which the generation of information related to the operation of the electronic device 100 is maintained for an amount of time. For example, a sleep release condition may include at least one of various states, such as a state in which a received call is connected, a state in which the call is performed for an amount of time after the call is connected, a state in which a message response is performed, a state in which a specific application is activated according to an input signal, and a state in which an activated application is operated for an amount of time.

The alarm operating unit 163 may detect a sleep time based on sleep start time information provided from the sleep determination unit 165 and a received time of alarm execution request information provided from the timer driving unit 161. Further, the alarm operating unit 163 may perform control to determine the alarm table 151 to output the alarm having characteristics according to the detected sleep time.

The alarm operating unit 163 may receive information on the operation of the electronic device 100 before receiving alarm execution request information after receiving sleep start time information from the sleep determination unit 165. Further, the alarm operating unit 163 may receive new sleep start time information before receiving alarm execution request information. Accordingly, the alarm operating unit 163 may determine sleep start time information and the information on the operation of the electronic device 100 to calculate a first sleep time. Further, the alarm operating unit 163 may calculate a second sleep time according to reception of the sleep start time information and the alarm execution request information. In this manner, the alarm operating unit 163 may calculate a plurality of sleep times after a bedtime comes. In this case, the alarm operating unit 163 may sum a plurality of sleep times to calculate a total sleep time, and/or may sum the sleep times by applying a respective weight to respective sleep times. The alarm operating unit 163 may allocate an applied weight to be lower if a calculated number of sleep times is increased. Further, the alarm operating unit 163 may apply a relatively high weight if asleep time calculated by using an alarm start time is long. The alarm operating unit 163 may apply a relatively low weight if the sleep time is short. Application of the high weight may correspond to applying a time subtracted from the calculated sleep time to be short. Application of the low weight may correspond to applying the time subtracted from the calculated sleep time to be long. Accordingly, a time determined to be a valid sleep time, form among calculated sleep times, may be increased if the weight becomes higher, whereas the time determined to be a valid sleep time, from among the calculated sleep times, may be decreased if the weight becomes lower.

For example, there is a case where it is determined that a user went to sleep at p.m. 10:00 in a state in which an alarm is set at 8:00 A.M. Accordingly, in such a case, a total sleep time may be 10 hours. In this case, if call connection for 20 minutes is achieved at about 12 o'clock at night by connecting a communication call, the sleep determination unit 165 may calculate 2 hours as a first sleep time. Further, if it is determined that information related to the operation of the electronic device 100 is not generated, the sleep determination unit 165 may provide 1:00 A.M. to the alarm operating unit 163 as second sleep start time information. After that, if the alarm time comes, the alarm operating unit 163 may collect the first sleep time, which is two hours from 10:00 P.M. to 00:00 A.M., and a second sleep time which is seven hours from 1:00 A.M. to 8:00 A.M., as the total sleep time.

The alarm operating unit 163 may sum, according to a design method, the first sleep time and the second sleep time without applying a separate weight to determine that the sleep time is 9 hours and may output an alarm of a pertinent preset characteristic. Alternatively, the alarm operating unit 163 may determine only a part of the first sleep time to be a sleep time by applying a weight of 0.7 to the first sleep time. The alarm operating unit 163 may determine only a part of the second sleep time to be the sleep time by applying a weight of 0.8 to the second sleep time. Alternatively, the alarm operating unit 163 may calculate the sleep time by applying the same weight or different weights to both of the first sleep time and the second sleep time. The alarm operating unit 163 may control to output a specific alarm by comparing a sleep time in which an amount of time is subtracted according to application of the weight with the alarm table 151.

Meanwhile, the alarm operating unit 163 may apply different weights according to a generation time point of information corresponding to the operation of the electronic device 100 after start of the sleep. That is, the alarm operating unit 163 may control to apply a different weight to a case in which operation information of the electronic device 100 is generated at 1:00 A.M., and to a case in which the operation information of the electronic device 100 is generated at 3:00 A.M. during sleep from 10:00 P.M. to 8:00 A.M. For example, the alarm operating unit 163 may increase a reduced sleep time by applying a low weight to a sleep time calculated according to generation of the operation information of the electronic device 100 at 3:00 A.M.

Figure 3:
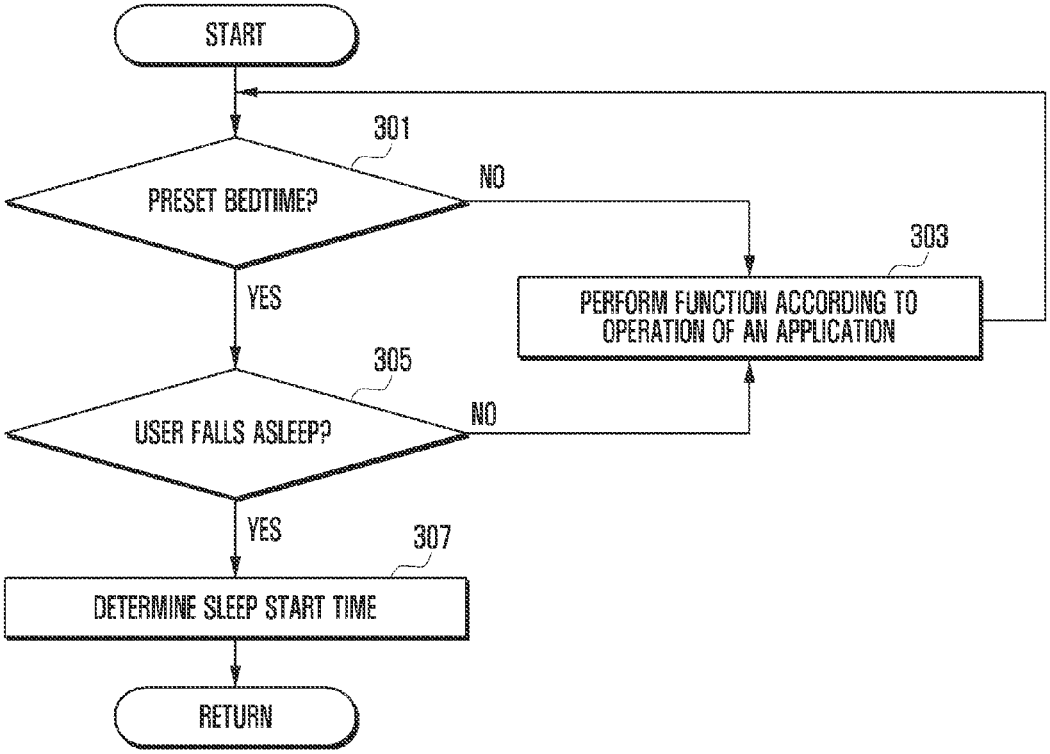
FIG. 3 is a flowchart illustrating a method of controlling an electronic device for setting an alarm according to an embodiment of the present disclosure.

FIG. 3 is a flowchart illustrating a method of controlling an electronic device to support an alarm function according to an embodiment of the present disclosure.

Referring to FIG. 3, in the method of controlling the electronic device according to the present disclosure, at operation 301, a controller 160 of the electronic device 100 determines whether a bedtime, which is previously set and/or preset by the user or the system, comes, or in other words, determines whether a preset bedtime occurs. To this end, the controller 160 may drive a timer to determine whether the bedtime comes. When the controller 160 determines that the bedtime does not come in operation 301, then, at operation 303, the controller 160 may perform a function according to an operation of an application of the electronic device 100.

On the other hand, when the controller 160 determines that the bedtime comes, at operation 301, then, at operation 305, the controller 160 may determine whether a sleep determination condition is satisfied. That is, at operation 305, the controller 160 may determine whether the user falls asleep. For instance, the controller 160 may determine occurrence of a non-operation state, for example, the controller 160 may determine whether the electronic device 100 is not moved for a pre-defined time or more, and/or whether a specific application of the electronic device 100 is not performed for an amount of time or more. Further, the controller 160 may determine whether a surrounding illumination of the electronic device 100 is less than or equal to a preset value. To this end, the sensor unit 170 may further include an illumination sensor (not shown). Further, the controller 160 may determine whether the size of a neighboring audio signal is less than or equal to a certain decibel. When at least one of a plurality of conditions, from among the various sleep determination conditions, is satisfied according to a design method, the controller 160 may determine a current time to be a sleep start time, at operation 307. Next, the controller 160 may return to a specific state of the electronic device 100 to maintain a corresponding state. For instance, the controller 160 may maintain a turned-off state of the display unit 140. In addition, the controller 160 may play music. In a case of a music playback application, it may be excluded from types of applications which are determined, examined, and/or evaluated during a procedure of satisfying the sleep determination condition. Further, in a case of a radio listening function application, it also may be excluded from sleep determination condition examination items. The above applications, and any other similar and/or suitable application, may be excluded from the sleep determination condition and/or may include the sleep determination condition according to the design method and/or the selection of a user list.

At operation 305, if the sleep determination condition is not satisfied, that is, if the controller 160 determines that the user does not fall asleep at operation 305, such that preset operation information of the electronic device 100 is generated, the controller 160 may perform a function according to an operation of an application at operation 303. At operation 303, if a current time is a time after the coming of the bedtime, the controller 160 may perform operation 305 periodically and/or according to drive of the timer. That is, the controller 160 may control the drive of the timer by periodically determining whether operation information of the electronic device 100 is generated after the coming of the bedtime. Such an operation may be performed after the coming of the bedtime and before the coming of an alarm time, except for a sleep entry interval. That is, when the current time is determined as the sleep start time, the drive of the timer is terminated and a procedure of FIG. 3 may be terminated. In addition, if the operation information of the electronic device 100 is generated after the coming of the bedtime and before coming of the alarm time, the method of controlling the electronic device illustrated in FIG. 3 may be operated again to calculate the sleep time.

Figure 4:
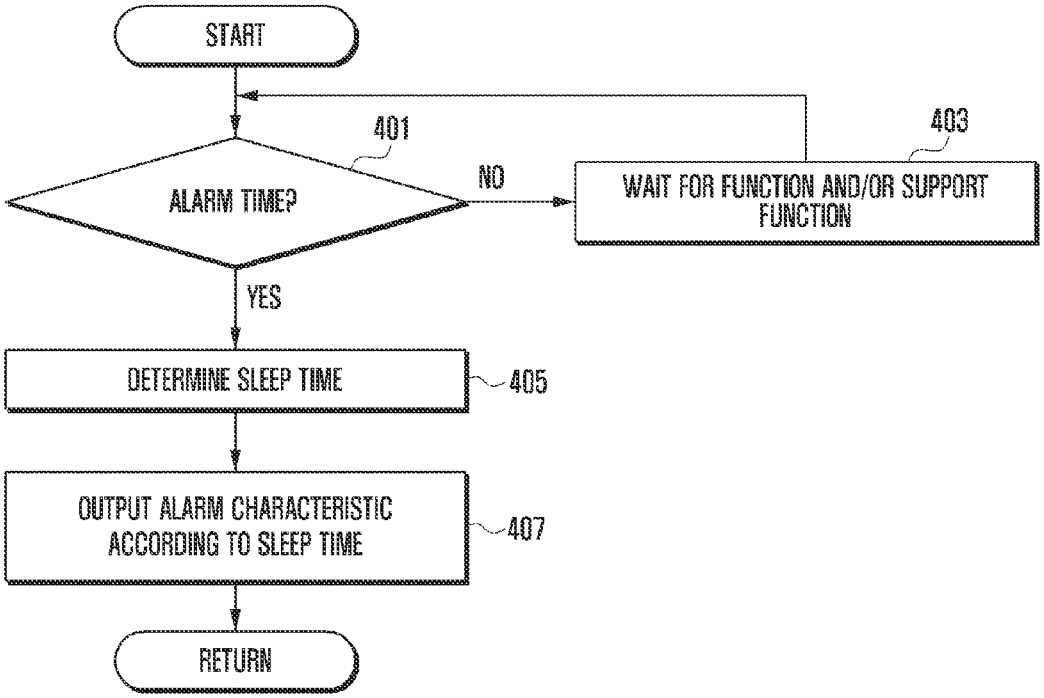
FIG. 4 is a flowchart illustrating a method of controlling an electronic device to execute an alarm according to an embodiment of the present disclosure.

FIG. 4 is a flowchart illustrating a method of controlling an electronic device to execute alarm according to an embodiment of the present disclosure.

Referring to FIG. 4, in the method of controlling the electronic device according to the present disclosure, at operation 401, the controller 160 may determine whether an alarm time comes, or in other words, determines whether an alarm time occurs. To this end, when the alarm time is set and an alarm function is activated, the controller 160 drives the timer to determine whether the alarm time comes. When the alarm time does not come, the controller 160 may wait a function and/or support a function at operation 403. For example, the controller 160 may output an idle screen, perform a specific application function according to generation of a menu screen and an input signal, and output information received from the exterior, or in other words, from a source external to the electronic device 100. Accordingly, at operation 401, the controller 160 may determine whether the alarm time comes in a time period. The coming of the alarm time may be determined according to interrupt generated due to termination of the driven timer.

When the alarm time comes at operation 401, the controller 160 may determine a sleep time at operation 405. In this case, the controller 160 may determine a time interval from the sleep start time, which is performed at operation 307, to the alarm start time to be the sleep time. When a new sleep start time is generated after sleep start before coming of the alarm time, according to generation of the operation information of the electronic device 100, the controller 160 may determine a plurality of sleep times that are after coming of the bedtime and before coming of the alarm time. Further, the controller 160 may calculate a valid sleep time by applying at least one of the above mentioned various weights to a plurality of sleep times according to the design method and/or user selection. For example, the controller 160 may calculate the valid sleep time by applying different weights to a summed sleep time according to at least one of a generation number of operations of the electronic device 100, a generation time slot of the operation of the electronic device, a length of an operation time of the electronic device 100, and lengths of the plurality of sleep times.

Meanwhile, although one sleep time is detected and/or determined, the controller 160 may calculate a valid sleep time by subtracting an amount of time from the collected sleep time by applying different weights depending on a sleep start time and a sleep location. Meanwhile, the embodiment of FIG. 4 is only described such that the sleep time is subtracted by applying the weight to calculate the sleep time, however, the present disclosure is not limited thereto. That is, the electronic device 100, according to an embodiment of the present disclosure, may calculate the valid sleep time by applying an additional weight according to the sleep start time and the sleep location to the sleep time calculated according to the design method and/or the user setting. A method of applying of the additional weight method may be applied to the above mentioned other weights. The electronic device 100 of the present disclosure may apply a sleep time calculation method which applies both a subtraction weight and an addition weight.

After that, at operation 407, the controller 160 may determine an alarm characteristic corresponding the calculated valid sleep time with reference to the alarm table 151, and may adjust and output the alarm characteristic. Next, the controller 160 may control to return to a function operation of the electronic device 100 and/or return to a previous state of alarm execution. Further, the controller 160 may perform a control operation, such as a driving of timer, so that a snooze function may be executed according to the adjusted alarm characteristic. When executing the snooze function, the controller 160 may control to perform an alarm set as default when each snooze execution time comes and/or to output an alarm of a characteristic corresponding to the calculated sleep time level.

Figure 5:
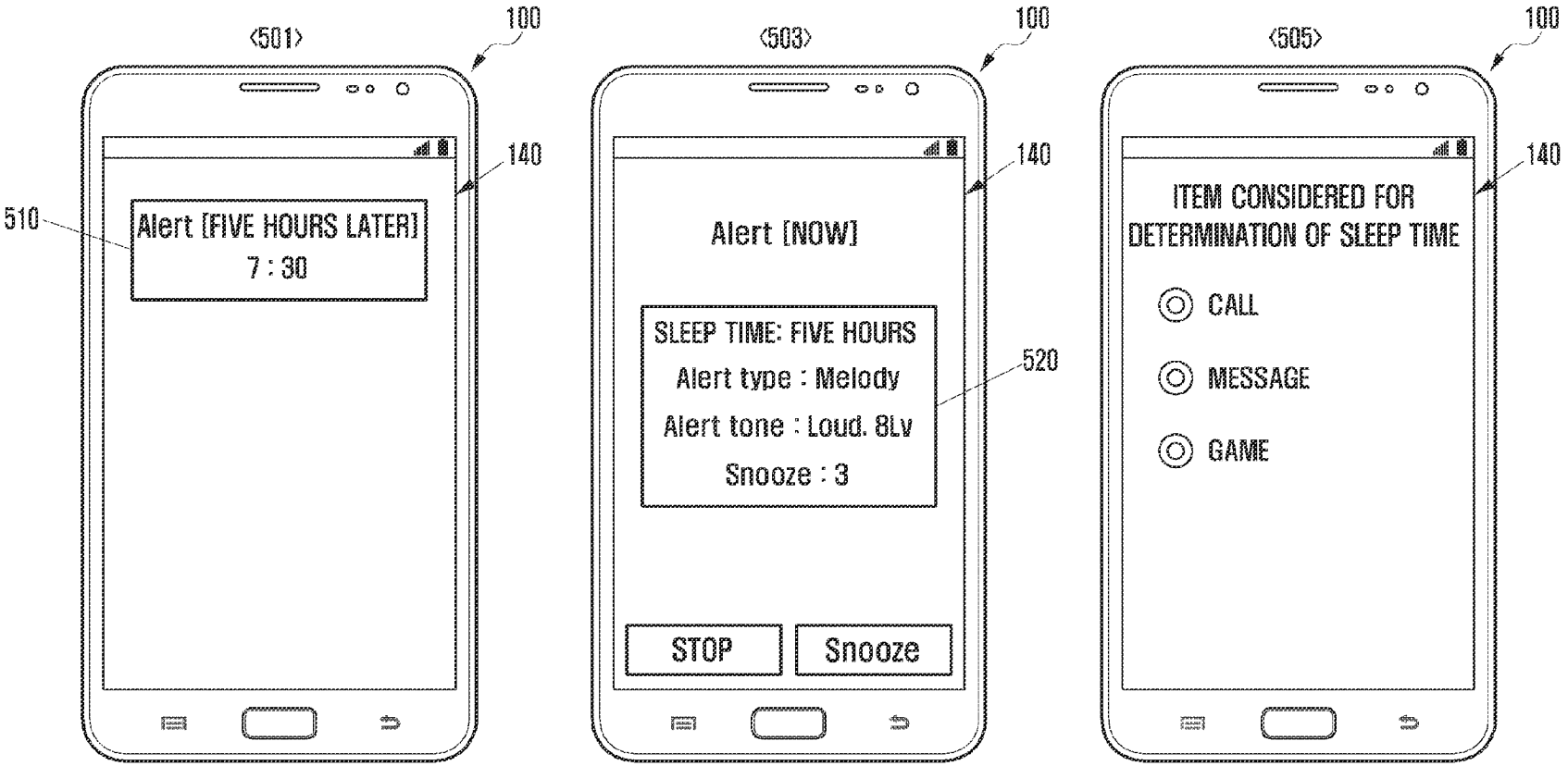
FIG. 5 is a diagram illustrating a screen interface to support an alarm control function according to an embodiment of the present disclosure.

FIG. 5 is a diagram illustrating a screen interface to support an alarm control function according to an embodiment of the present disclosure.

Referring to FIG. 5, the display unit 140 of the electronic device 100 may output alarm guide information 510 according to an alarm setting as illustrated in screen interface 501. In particular, the alarm guide information 510 output on the display unit 140 may include current time information and residual time information related to a time remaining for the alarm which will be performed later based on a current time. The alarm guide information 510 may be temporarily displayed and then removed when setting the alarm. The alarm guide information 510 may be continuously displayed or periodically displayed on the display unit 140 for an amount of time.

If the alarm time comes, the display unit 140 may output alarm execution information 520 as illustrated in screen interface 503. The alarm execution information 520 may include at least one of calculated sleep time information and information on alarm characteristics, such as an alarm type, an alarm tone, and a number of snoozes. The calculated sleep time information may be a total time information about a time from a sleep start time to an alarm start time and/or valid sleep time information to which at least one weight is applied. The controller 160 may control to display both of the total time information and the valid sleep time information.

Meanwhile, the electronic device 100 may provide at least one item, to be considered for calculation of the sleep time, in the form of a menu as illustrated in screen interface 505. As shown in the screen interface 505, at least one of a call item, a message item, and a game item may be selected. The user may select an item to restart a sleep start after the sleep is started. When at least one of the items displayed in screen interface 505 is selected, the electronic device 100 may provide a setting of detailed information of the selected item. For example, in a case of the call item, the controller 160 may provide an item for determining how many minutes of call is set as a restart of the sleep start. Meanwhile, various items, for example, a movement item, an illumination item, an audio item, and any other similar and/or suitable item, as well as the above mentioned items may be further included.

As described above, the alarm control function of the present disclosure may perform an alarm more suitable for a user state by adaptively providing alarm characteristics pertinent to sleep information of the user. Accordingly, the present disclosure may provide more improved alarm function usage.

Meanwhile, in the operation of the electronic device 100 in order to determine the sleep information in the foregoing description, the sleep start time may be determined by a specific input signal and/or gesture information input for a sleep start by the user, in addition to a case in which operation information of the electronic device 100 is not generated for an amount of time. That is, the user may push a specific key corresponding to determination of the sleep start by the electronic device 100, activate an application to calculate the sleep time on the display unit 140 of a touch function, and/or generate a previously defined gesture event. Accordingly, the electronic device 100 may collect information of time when a user input is generated as sleep start time information. When the user directly inputs the sleep start time, the electronic device 100 may calculate a sleep time to be from the sleep start time to an alarm start time regardless of coming of the bedtime. The electronic device 100 may collect sleep start time information according to schedule information that is set by the user. That is, when the user sets schedule information to a bedtime of 10:00 P.M., the electronic device 100 may collect the bedtime of 10:00 P.M. from the schedule information as start time information.

As described above, the method of controlling an alarm and the electronic device 100 supporting the same according to an embodiment of the present disclosure may support the user to conveniently adjust execution conditions of the alarm.

The above mentioned electronic device 100 may further include various additional modules according to provision type. That is, when the electronic device 100 is a communication terminal, it may further include components that are not mentioned above, such as a Near Field Communication (NFC) module for NFC, an interface for data transmission and/or reception in a wired and/or wireless communication method of the electronic device 100, an Internet communication module communicating with an Internet network to perform an Internet function, a digital broadcasting module receiving and playing digital broadcasting, and any other similar and/or suitable communication components. Since such components may be variously changed according to a trend of digital convergence, not all such components may be listed here. However, the electronic device 100 may further include components of a same level as that of the above-mentioned components. Further, the electronic device 100 according to an embodiment of the present disclosure may be substituted by specific constructions in the foregoing arrangements according to the provision type or another structure. This can be easily understood to those skilled in the present art.

In addition, the electronic device 100, according to an embodiment of the present disclosure, may include various information communication devices, multi-media devices, and application devices thereof, such as a Portable Multimedia Player (PMP), a digital broadcasting player, a Personal Digital Assistant (PDA), a music player, (e.g., a Motion Picture Expert Group (MPEG) Audio Layer 3 (MP3) player), a portable game terminal, a Smart Phone, a notebook computer, and a hand-held Personal Computer (PC) as well as mobile communication terminals operating based on communication protocols corresponding to various communication systems.

As is clear from the forgoing description, according to the method of controlling an alarm and the electronic device supporting the same of the present disclosure, the present disclosure may provide more improved alarm control function.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method of controlling an alarm in an electronic device, the method comprising:

determining sleep start time information and alarm start time information;

calculating a sleep time based on the sleep start time information and the alarm start time information;

calculating a valid sleep time by applying a weight determined by a controller of the electronic device according to at least one of a sleep start time slot and a sleep location to the sleep time; and outputting an alarm having a different characteristic according to a length of the valid sleep time.

2. The method of claim 1, wherein the determining of the sleep start time information comprises at least one of:

determining a reception time of an input signal indicating a sleep start as a sleep start time;

determining the sleep start time from preset schedule information; and determining the sleep start time when operation information of the electronic device is not generated for an amount of time after a previously defined bedtime.

3. The method of claim 1, wherein the determining of the sleep start time information comprises determining a sleep start time according to at least one of the electronic device not being moved for an amount of time, an application of the electronic device being not operated for an amount of time, a neighboring illumination of the electronic device being less than or equal to a certain value, and a neighboring audio signal decibel level of the electronic device being less than or equal to a value.

4. The method of claim 1, wherein the calculating of the sleep time comprises:

operating the electronic device during an interval from a sleep start time to a time corresponding to generation of the alarm;

calculating a first sleep time that is from the sleep start time to a generation of an operation of the electronic device;

calculating a second sleep time that extends to the generation of the alarm after restarting the sleep start time as the operation of the electronic device is terminated; and calculating a valid sleep time by summing the first sleep time and the second sleep time.

5. The method of claim 4, wherein the calculating of the sleep time comprises calculating the valid sleep time by applying a weight determined by a controller of the electronic device according to at least one of a generation number of the operation of the electronic device, a generation time of the operation of the electronic device, a length of an operation time of the electronic device, and a length of the sleep time to the summed sleep time, and wherein the outputting of the alarm comprises outputting an alarm having a different characteristic corresponding to a length of the valid sleep time.

6. The method of claim 1, wherein the outputting of the alarm comprises:

outputting a relatively noisy alarm when the sleep time is short; and outputting a relatively silent alarm when the sleep time is long.

7. The method of claim 1, further comprising displaying alarm guide information including a residual time, the residual time being from a current time to a coming of the alarm.

8. The method of claim 1, further comprising displaying alarm execution information including at least one of sleep time information, an alarm type, an alarm tone, and a number of snoozes.

9. The method of claim 8, wherein the alarm execution information comprises at least one of:

total sleep time information corresponding to a sleep time extending from a sleep start time to generation of the alarm, and valid sleep time information to which a weight determined by the controller of the electronic device is applied according to at least one of the sleep location, a sleep time slot, or an operation of the electronic device performed during sleep.

10. An electronic device comprising:

a controller configured to:

determine sleep start time information and alarm start time information, calculate a sleep time based on the sleep start time information and the alarm start time information, calculate a valid sleep time by applying a weight determined by the controller according to at least one of a sleep start time slot and a sleep location to the sleep time, and control output of an alarm having a different characteristic according to a length of the valid sleep time; and an output unit configured to output the alarm.

11. The electronic device of claim 10, wherein the controller is further configured to:

determine a reception time of an input signal indicating a sleep start as a sleep start time, determine the sleep start time from preset schedule information, and determine the sleep start time when operation information of the electronic device is not generated for an amount of time after a preset bed time.

12. The electronic device of claim 10, wherein the controller is configured to determine a sleep start time according to at least one of the electronic device not being moved for an amount of time, the electronic device not being operated for the amount of time, a neighboring illumination of the electronic device being less than or equal to a certain value, and a neighboring audio signal decibel level of the electronic device being less than or equal to a value.

13. The electronic device of claim 10, wherein the controller is further configured to:

calculate a first sleep time that is from a sleep start time to a generation of an operation of the electronic device when the electronic device is operated during an interval from the sleep start time to a time corresponding to generation of the alarm, calculate a second sleep time that extends to the generation of the alarm after restarting the sleep start time as the operation of the electronic device is terminated, and calculate a valid sleep time by summing the first sleep time and the second sleep time.

14. The electronic device of claim 13, wherein the controller is further configured to:

calculate the valid sleep time by applying a weight determined by the controller according to at least one of a generation number of the operation of the electronic device, a generation time of the operation of the electronic device, a length of an operation time of the electronic device, and a length of the sleep times to the summed sleep time, and control output of an alarm having a different characteristic according to a length of the valid sleep time.

15. The electronic device of claim 10, wherein the output unit is further configured to output a relatively noisy alarm when a sleep time is short and to output a relatively silent alarm when the sleep time is long.

16. The electronic device of claim 10, further comprising a display unit configured to display alarm guide information including a residual time, the residual time being from a current time to a coming of the alarm.

17. The electronic device of claim 10, further comprising a display unit configured to display alarm execution information including at least one of sleep time information, an alarm type, an alarm tone, and a number of snoozes.

18. The electronic device of claim 17, wherein the alarm execution information comprises at least one of:

total sleep time information corresponding to a sleep time extending from a sleep start time to generation of the alarm, and valid sleep time information to which a weight determined by the controller is applied according to at least one of the sleep location, a sleep time slot, and an operation of the electronic device performed during sleep.

* * * * *